US006499760B1

(12) United States Patent
Tindall et al.

(10) Patent No.: US 6,499,760 B1
(45) Date of Patent: Dec. 31, 2002

(54) RELEASABLE FASTENING FOR ATTACHING BOOTS TO SNOWBOARDS

(76) Inventors: James Justin Tindall, 27 St. Crispins Close, Hampstead, London NW3 2QF (GB); Andrew Horsfall, 4A Mildway Road, Chelmsford, Essex CM2 0DX (GB); James Edward George Eastwood, 14 Duncan Terrace, London N1 8BZ (GB); Jonathan Graham Roy Tallis, 8 Hazelbank, Hazelbeach, Milford Haven, Pembrokeshire SA73 1EN, Wales (GB)

( * ) Notice: Subject to any disclaimer, the term of this patent is extended or adjusted under 35 U.S.C. 154(b) by 0 days.

(21) Appl. No.: 09/597,333

(22) Filed: Jun. 19, 2000

(30) Foreign Application Priority Data

Jun. 22, 1999 (GB) ..... 9914450

(51) Int. Cl.[7] ..... A63C 9/081
(52) U.S. Cl. ..... 280/618; 280/607; 280/14.21
(58) Field of Search ..... 280/613, 611, 280/617, 618, 607, 14.21, 623, 624, 625, 631, 632, 634

(56) References Cited

U.S. PATENT DOCUMENTS 5,732,959 A * 3/1998 Soejima ..... 280/14.2
5,762,357 A * 6/1998 Ratzek et al. ..... 280/607
5,791,678 A * 8/1998 Perlman ..... 280/618
5,954,358 A * 9/1999 Bejean et al. ..... 280/14.2 X
5,971,420 A * 10/1999 Okajima et al. ..... 280/14.2 X
5,971,422 A * 10/1999 Anderson et al. ..... 280/624
6,155,578 A * 12/2000 Patterson ..... 280/14.2
6,203,052 B1 * 3/2001 Dodge ..... 280/624

FOREIGN PATENT DOCUMENTS

| | | | |
|---|---|---|---|
| EP | 761261 | * | 3/1997 |
| EP | 838249 | * | 4/1998 |
| FR | 2627097 | * | 4/1989 |
| JP | 8257201 | * | 10/1996 |
| JP | 8257202 | * | 10/1996 |
| WO | 98/37933 | * | 9/1998 |

* cited by examiner

*Primary Examiner*—Brian L. Johnson
*Assistant Examiner*—Bryon Fischmann
(74) *Attorney, Agent, or Firm*—Melvin I. Stoltz

(57) ABSTRACT

A releasable fastening assembly for attachment of a boot to a snowboard comprises a mounting member which, in use, is fixed to the snowboard, and a support member which is rotatable relative to the mounting member. First and second jaws are mounted on the support member for engagement with co-operating formations on the boot. Means are provided for releasably holding the support member in a selected one of a plurality of possible angular positions relative to the mounting member and for disengaging at least one of the jaws from the cooperating formations on the boot.

6 Claims, 5 Drawing Sheets

FIGURE 6
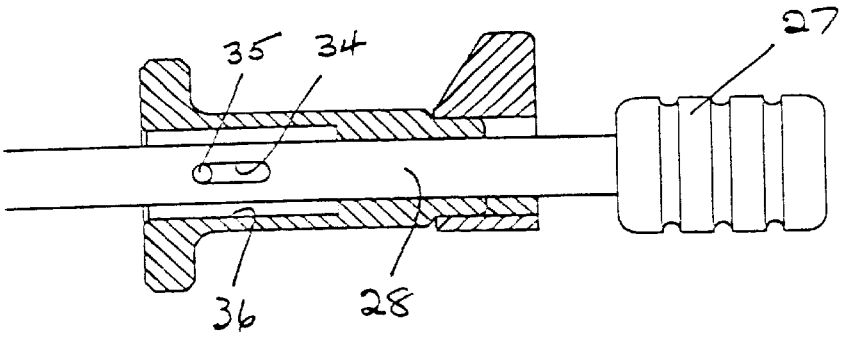
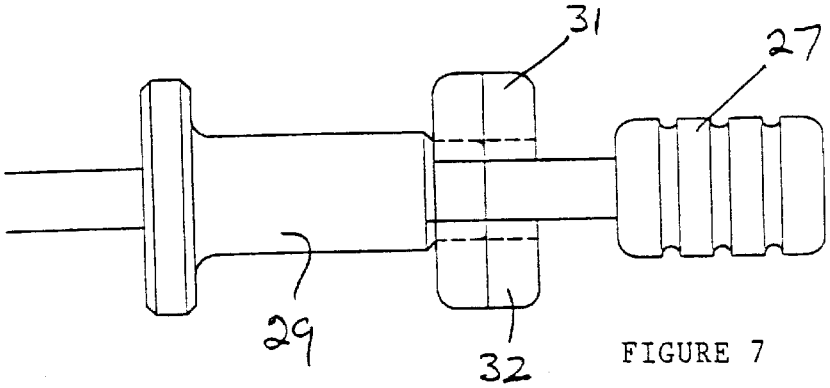
FIGURE 7
FIGURE 8
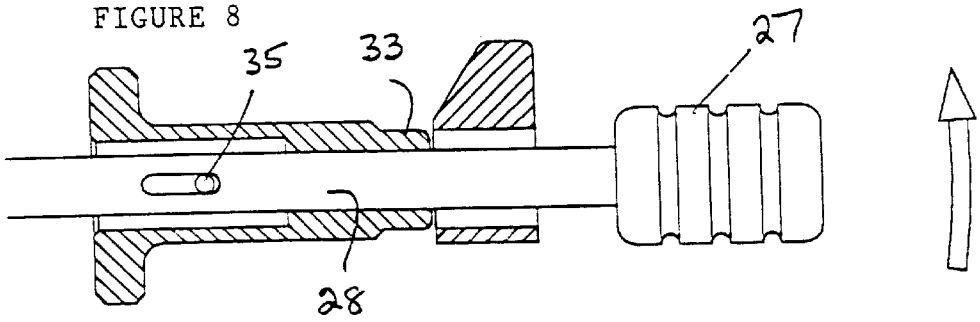
FIGURE 9
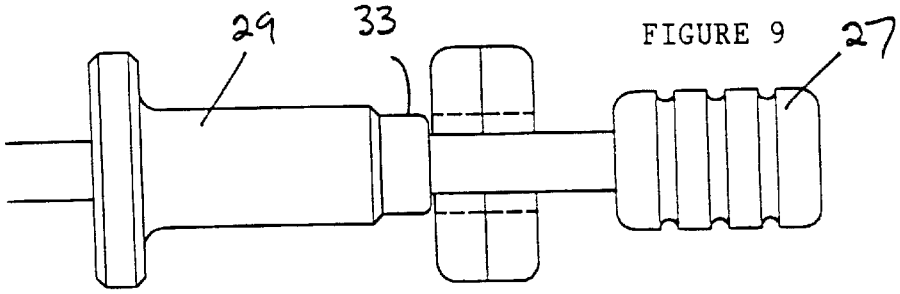

RELEASABLE FASTENING FOR ATTACHING BOOTS TO SNOWBOARDS

FIELD OF THE INVENTION

This invention relates to releasable fastenings for attaching boots to snowboards.

Snowboards have been in use for a number of years and snowboarding has become a popular winter sports activity in those countries which have substantial snowfalls. With the increasing popularity of the sport there has come a desire for the user to be able to attach his or her boots to the board in a simple and effective manner. It is also desirable that attachment of the boots to the board and release of the boots from the board can be carried out in a very short time.

It is accordingly an object of the present invention to provide a fastening system which meets these desiderata.

Some snowboarders keep their feet (and thus their boots) at fixed orientations relative to the longitudinal axis of the board, whereas others prefer to have the possibility of adjusting the orientations of their boots about an axis normal to the upper surface of the board.

It is accordingly a further object of the present invention to provide a fastening system which includes means whereby a snowboarder can readily adjust the orientation of his or her boots.

SUMMARY OF THE INVENTION

According to a first aspect of the present invention there is provided a releasable fastening for attachment of a boot to a snowboard, said fastening comprising a mounting member which, in use, is fixedly attached to the snowboard, a support member which is rotatable relative to the mounting member, first and second jaws mounted on the support member and arranged for engagement with cooperating formations on the boot, means for releasably holding the support member in a selected one of a plurality of possible angular positions relative to the mounting member and means for disengaging at least one of said first and second jaws from the cooperating formations on the boot.

Said first and second jaws are preferably so arranged that the first jaw is arranged to engage a cooperating formation on the boot which is positioned adjacent the toe end of the boot while the second jaw is arranged to engage a cooperating formation on the boot positioned at or adjacent the heel end of the boot. The disengaging means preferably acts on the second jaw, i.e. that positioned at or adjacent the heel end of the boot. Said second jaw is preferably arranged for pivotal movement about an axis located beneath the portion of the second jaw which engages the cooperating formation on the boot.

The mounting member which is fixedly attached to the snowboard preferably comprises a disc having a circumferential step portion, which circumferential step portion cooperates with the adjacent surface of the snowboard to define a location recess for a complementary part of the support member. Said circumferential step portion of the mounting member is preferably formed to provide an array of outwardly extending teeth, with the angles between adjacent teeth defining the spacings between adjacent selectable positions of the support member relative to the mounting member.

The first jaw preferably includes a mounting for a spring-loaded index member which resiliently engages in the spaces between the teeth of the circumferential step portion to provide a resilient restraint to angular movement of the support member relative to the mounting member.

The second jaw is preferably arranged for movement about its axis upon actuation of a lever which also serves to effect operation of a locking member engageable with the teeth of the circumferential step portion of the mounting member.

Thus, according to a second aspect of the present invention there is provided a releasable fastening for attachment of a boot to a snowboard, which fastening includes holding means for holding the boot in engagement with the snowboard, means permitting rotation of the boot retative to the snowboard when held in engagement with the snowboard and for locking the engaged boot in a selected angular position relative to the snowboard and a common operating member for effecting release of the holding means and the locking means.

The common operating member is preferably normally maintained in a position in which the holding means and the locking means are both operative. The common operating member is preferably movable from said "normal" position into a first release position in which one of said holding means and said locking means is released and into a second release position in which both said holding means and said locking means are released.

The common operating member is preferably biased by spring means into said first release position and is movable manually in one direction into said "normal" position and in the opposite direction into the second release position.

BRIEF DESCRIPTION OF THE DRAWINGS

FIGS. 6 and 7 show the common operating member held in its "normal" or locking position, FIGS. 8 and 9 show the common operating member when released for movement into the first release or the second release position.

DESCRIPTION OF THE PREFERRED EMBODIMENTS

Figure 1:
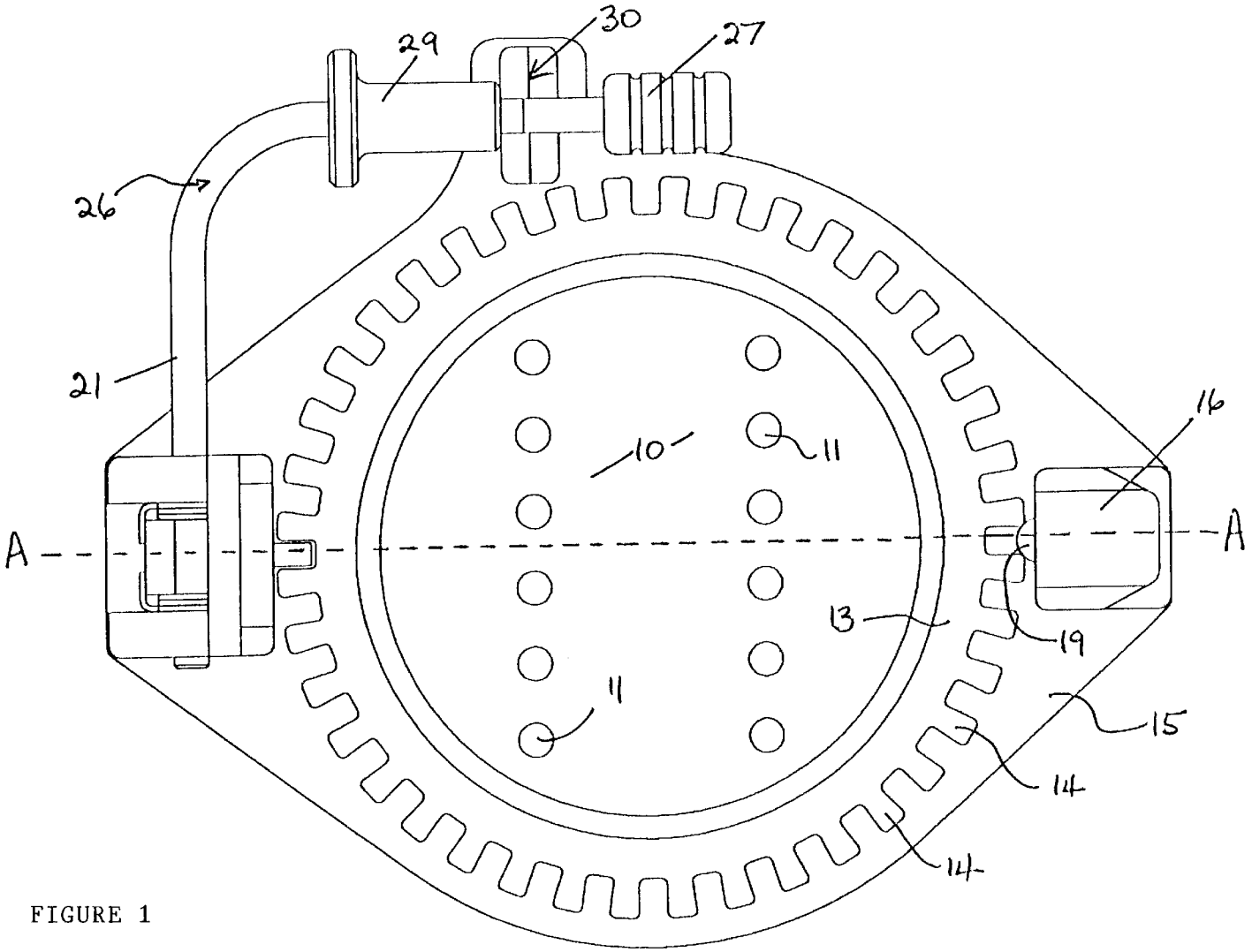
FIG. 1 is a plan view of a releasable fastening for attachment of a boot to a snowboard.

It will be appreciated that the fastening shown in FIG. 1 is one of two such fastenings located at spaced positions along the length of the snowboard, one for receiving the right boot of the snowboarder and the other for receiving the left boot of the snowboarder. Each boot includes a pair of transversely extending bars located in recesses in the underside of the boot, one bar being underneath the heel of the boot and the other bar being located towards the toe end of the boot.

The fastening includes a mounting member 10 in the form of a circular plate of, for example, stainless steel, aluminium or a suitable plastics material, which has a number of apertures 11 (as shown there are twelve apertures 11) for receiving screws or bolts (not shown) for attachment of the mounting member 10 to the snowboard 12. The snowboard 12 will typically be provided with a number of inset internally threaded sockets (not shown) and the screws or bolts will engage the inset sockets.

The mounting member 10 has a circumferential step portion 13 which provides a plurality of outwardly directed angularly spaced teeth 14. As shown, there are forty teeth 14 and the troughs between adjacent teeth 14 are of substantially the same angular extent as the teeth. The circumferential step portion 13 of the mounting member 10 cooperates with the snowboard 12 to position a support member 15 which is of somewhat lozenge-shape in plan view (as can be seen from FIG. 1) and has a central aperture which receives the central portion of the mounting member 10 so that the support member 15 is rotatable relative to the mounting member 10 and hence relative to the snowboard 12.

A first jaw 16 projects upwardly from the support member 15 and is arranged for engagement with the bar adjacent the toe end of the boot of the user. Said first jaw 16 is a fixed jaw and, as shown in FIGS. 2 to 5, it has a horizontally extending open mouth 17 to receive the bar of the boot. The jaw 16 includes a mounting for a spring 18 which acts on a detent 19 having a curvate presented face directed towards the teeth 14 of the mounting member 10. The curvate face of the detent 19 will engage between a pair of adjacent teeth 14 and will provide a resilient restraint against rotation of the support member 15 relative to the mounting member 10. If, however, the support member 15 is otherwise free to rotate relative to the mounting member 10, the application of a torque above a predetermined minimum value to the support member 15 will serve to overcome the restraint afforded by the spring-loaded detent 19 and will effect rotation of the support member 15 relative to the mounting member 10.

Although the detent 19 is shown combined with the jaw 16, the detent could be mounted separately, anywhere around the circumference of the mounting member 10.

A second jaw 20 is provided on the support member 15 and is positioned diametrically opposite the first jaw 16. The second jaw 20 is a movable jaw and is arranged for spring-loaded pivotal movement about the axis of a shaft 21 relative to a fixed abutment member 22. The second, movable jaw 20 has a horizontally directed mouth 23 to receive the bar beneath the heel of the boot of the user. The movable jaw 20 and the abutment member 22 have upwardly directed surfaces 24 and 25 which are inclined to the horizontal such that, when the user engages the bar adjacent the toe end of his boot with the fixed jaw 16 and then presses his or her heel downwardly, the bar beneath the heel of the boot will displace the second movable jaw 20 against the action of its spring-loading and will enter the mouth 23. The boot will then be held securely in engagement with the support member 15 (and hence with the snowboard 12) by virtue of the engagement of the two bars with the two jaws 16 and 20.

The shaft 21 is part of an operating lever 26 having a knob 27 at its free end. The part 28 of the operating lever 26 adjacent the knob 27 carries a spring-loaded sleeve 29 which is movable into and out of engagement with an up-standing boss 30 carried on the support member 15. The boss 30 includes two spaced projections 31 and 32 which are spaced apart a distance such that the part 28 of the operating lever 26 can pass freely through them. The surfaces of the two projections 31 and 32 which face towards one another are provided at their lower ends with part-cylindrical rebates to receive a reduced diameter end portion 33 of the sleeve 29.

Sleeve 29 is formed with a longitudinally extending slot 34 in which a pin 35 is received. The pin 35 passes through a bore in the part 28 of the operating lever 26. A spring (not shown) contained within a recess 36 in the sleeve 29 acts between the pin 35 and the base of the recess 36. The arrangement is such that the spring normally biases the sleeve 29 into the position shown in FIGS. 6 and 7 in which the reduced diameter end portion 33 of the sleeve 29 engages with the part-cylindrical rebates at the lower ends of the facing surfaces of the projections 31 and 32 to hold the sleeve 29 and thus the operating lever 26 against movement away from the support member 15.

When the sleeve 29 is moved manually against the action of the spring so that the reduced diameter end portion 33 is moved clear of the part-cylindrical rebates, the operating lever 26 will then be free to move away from the support member 15, as indicated in FIGS. 8 and 9.

Figure 2:
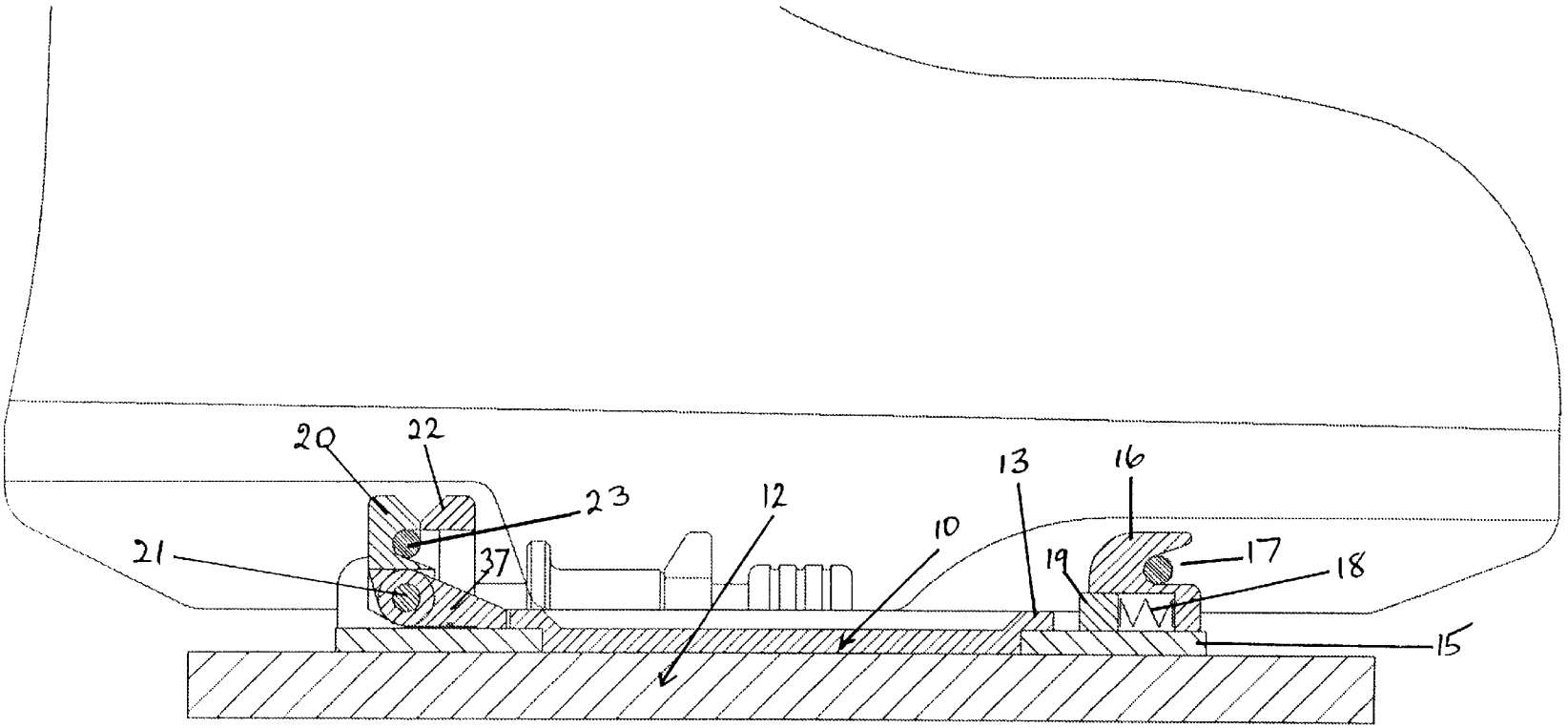
FIG. 2 is a vertical sectional view of the fastening taken along the line A—A of FIG. 1.
Figure 3:
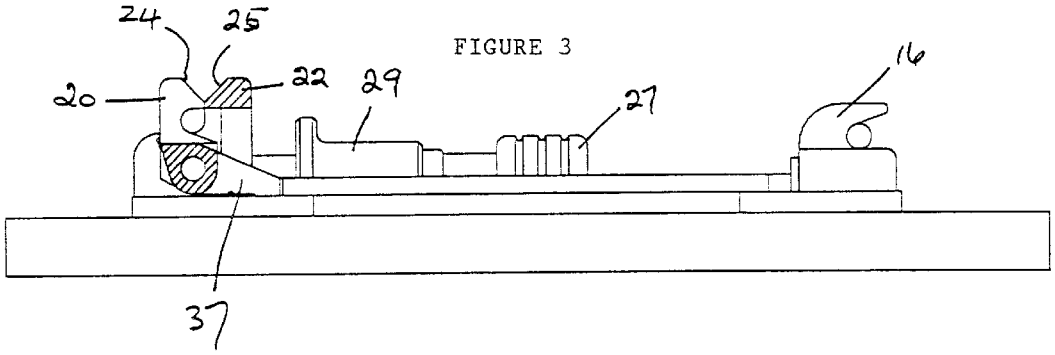
FIG. 3 is a view showing certain parts of the fastening in the positions which they occupy when the fastening is in its "normal" or locked condition and the boot is held in engagement with the snowboard and cannot be rotated relative to the snowboard.

The shaft 21 carries a pawl 37 part of which is shaped to fit between a pair of adjacent teeth 14 of the mounting member 10 so that, in the condition shown in FIGS. 1 to 3, the support member 15 is held against rotation relative to the mounting member 10. When the operating lever 26 is moved from the position shown in FIG. 3 into the position shown in FIG. 4, the pawl 37 will be moved clear of the teeth 14 and the support member 15 (and the boot) will be free to rotate relative to the snowboard 12. If, therefore, the snowboarder wishes to adjust the inclination of his boot to the longitudinal axis of the snowboard 12, he will pull the sleeve 29 from the position shown in FIGS. 6 and 7 into the position shown in FIGS. 8 and 9 allowing the operating lever 26 to move from the position shown in FIG. 3 into the position in FIG. 4. The snowboarder wilt then turn his or her boot into the required new position, without detaching the boot from the snowboard, and will then press down on the knob 27 to return the operating lever 26 into the FIG. 3 position and move the pawl 37 back into its blocking position between a pair of the teeth 14 of the mounting member 10. Adjustment of the inclination of each boot can thus be effected simply without need for removal of the boots from the snowboard 12.

Figure 4:
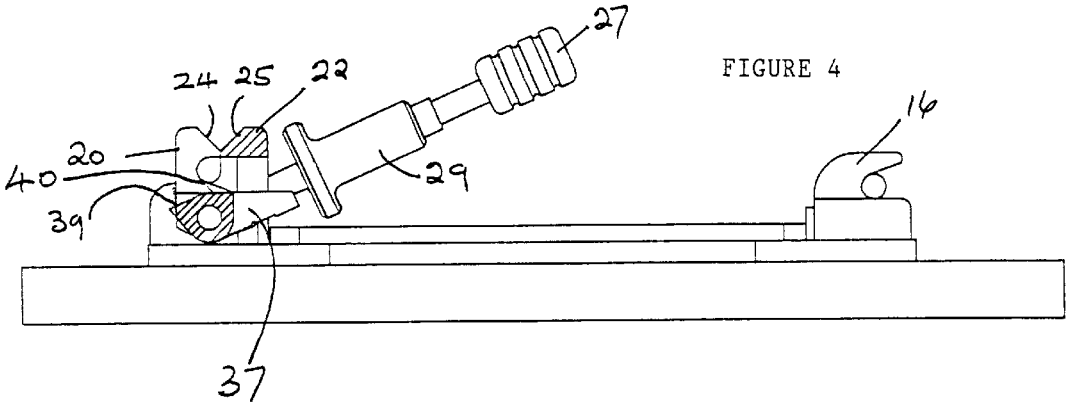
FIG. 4 is a view corresponding to FIG. 3 but showing the relevant parts of the fastening in the first release position, in which the boot can be rotated relative to the snowboard but cannot be separated from the snowboard.
Figure 5:
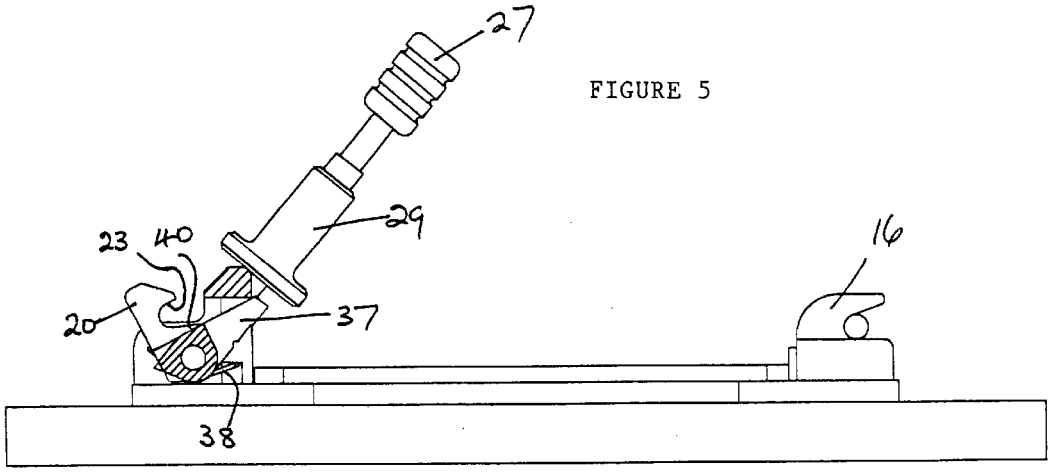
FIG. 5 is a view corresponding to FIG. 3 but showing the relevant parts of the fastening in the second release position, in which the boot can be separated from the snowboard and/or rotated relative to the snowboard.

A spring 38 acts between the pawl 37 and the movable jaw 20 and, as can be seen from FIGS. 3 to 5, the pawl 37 has an upper surface which includes two relatively inclined portions 39 and 40 which are alternatively engageable with the downwardly presented surface of the movable jaw 20.

In the locked position, as shown in FIGS. 1 to 3, portion 39 of the upper surface of the pawl 37 is in engagement with the downwardly presented surface of the movable jaw 20. When the sleeve 29 is disengaged from the boss 30, the operating lever 26 will be moved, under the action of the spring 38, into the position shown in FIG. 4 in which portion 40 of the upper surface of the pawl 37 is in engagement with the downwardly presented surface of the movable jaw 20. The jaw 20 has, however, not moved from its original position, in engagement with the abutment member 22 and the bar beneath the heel of the boot is held in the mouth 23 of the movable jaw 20.

When the knob 27 is moved upwardly from the position shown in FIG. 4 into the position shown in FIG. 5, the operating lever 26 will turn through a further angle and the engagement of inclined portion 40 of the upwardly presented surface of the pawl 37 with the downwardly presented surface of the movable jaw 20 will cause the movable jaw 20 to be rotated from the position shown in FIG. 4 into the position shown in FIG. 5. The gripping action on the bar beneath the heel of the boot will thus be released and the snowboarder will then be able to detach his boot from the snowboard 12.

It is to be noted that, as the operating lever 26 moves from the position shown in FIG. 3 into the position shown in FIG. 4, the pawl 37 moves relative to the movable jaw 20 assisted by the action of the spring 38. When the operating lever 26 is moved from the position shown in FIG. 4 into the position shown in FIG. 5, the movable jaw 20 and the pawl 37 move together about the axis of the shaft 21, once more against the action of the spring 38.

The logic of the system described above is such that, in the locked position shown in FIG. 3, the boot cannot be removed from the snowboard 12 and cannot be rotated relative to the snowboard 12. In the first release position shown in FIG. 4, the boot can be rotated relative to the snowboard 12 but cannot be removed from the snowboard 12. In the second release position shown in FIG. 5, the boot can be rotated relative to the snowboard 12 and can be removed from snowboard 12.

Figure 10:
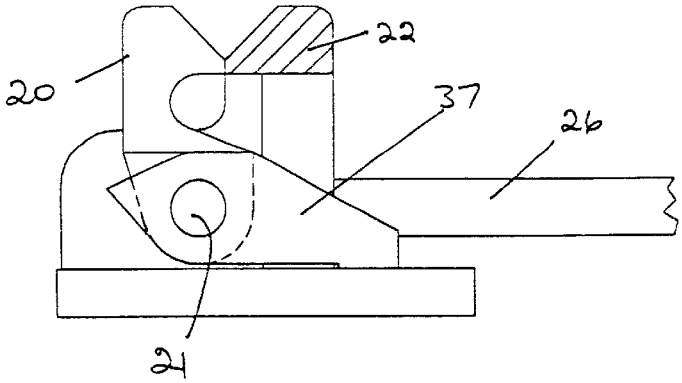
FIGS. 10, 11 and 12 are detail views showing three positions of a modified form of fastening.
Figure 11:
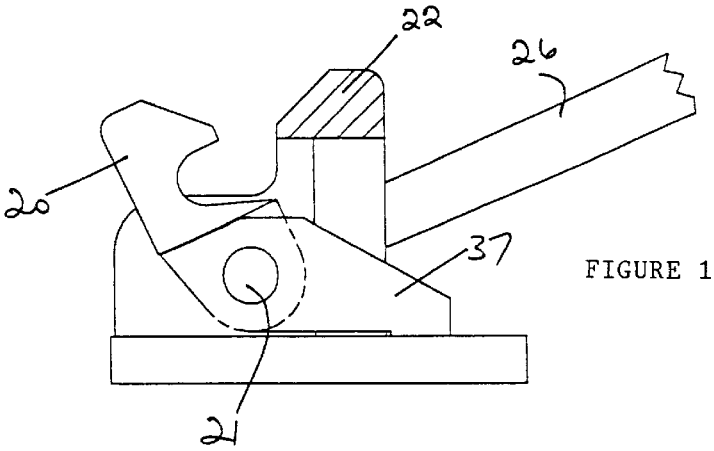
Figure 12:
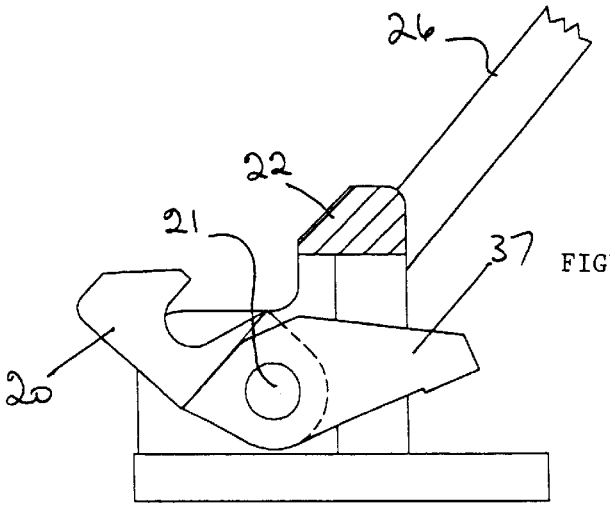

In the modified form of fastening shown in FIGS. 10 to 12, the same reference numerals are used to indicate components which correspond to the components of the embodiment shown in FIGS. 1 to 9. A different logic is employed with the embodiment of FIGS. 10 to 12. Thus, FIG. 10 shows the locked position in which the boot cannot be removed from the snowboard 12 and cannot be rotated relative to the snowboard 12. FIG. 11 shows the first release position in which the boot can be removed from the snowboard 12 but cannot be rotated relative to the snowboard 12, and FIG. 12 shows the second release position in which the boot can be removed from the snowboard 12 and can be rotated relative to the snowboard 12.

In the embodiment shown in FIGS. 1 to 9, the shaft 21 is keyed to the pawl 37 whereas, in the embodiment shown in FIGS. 10 to 12, the shaft 21 is keyed to the movable jaw 20. As can be seen from FIGS. 10 to 12, the profile of the pawl 37 of the embodiment of FIGS. 10 to 12 is changed as compared to that of the pawl 37 of the embodiment shown in FIGS. 1 to 9 and the springing (not shown) is changed to provide the desired functions.

What is claimed is:

1. A releasable fastening assembly for attaching a boot to a snowboard, said fastening assembly comprising:

A. a mounting member fixedly attachable to a snowboard and comprising disc having a circumferential step portion, said step portion being a. constructed for cooperating engagement with a portion of a support member, and b. comprising a plurality of outwardly extending teeth, with the angles between adjacent teeth defining the spacing between adjacent selectable positions of the support member relative to the mounting member;

B. a support member cooperatively associated with the mounting member for rotatable movement relative thereto and comprising a first jaw and a second jaw mounted thereto and constructed for engagement with a boot, said first jaw comprising a mounting for a spring-loaded indexed member which resiliently engages in the spaces between the teeth of the circumference step portion to provide a resilient restraint to angular movement of the support member relative to the mounting member;

C. means for releasably holding the support member in a selected one of a plurality of possible angular positions relative to the mounting member, and D. means for disengaging at least one of said first and second jaws from the boot.

2. A releasable fastening assembly as claimed in claim 1, in which the first jaw is arranged to engage a cooperating formation on the boot which is positioned adjacent the toe end of the boot while the second jaw is arranged to engage a cooperating formation on the boot positioned adjacent the heel end of the boot.

3. A releasable fastening assembly as claimed in claim 2, in which the disengaging means acts on the second jaw.

4. A releasable fastening assembly as claimed in claim 3, in which the second jaw is arranged for pivotal movement about an axis located beneath a portion of the second jaw which engages the cooperating formation on the boot.

5. A releasable fastening assembly as claimed in claim 1, in which the second jaw is arranged for movement about its axis upon actuation of a lever which also serves to effect operation of a locking member engageable with the teeth of the circumferential step portion of the mounting member.

6. A releasable fastening assembly as claimed in claim 1, in which the release means comprises an operating lever which is movable manually into first and second release positions.

* * * * *